US006955384B1

(12) United States Patent
Good

(10) Patent No.: US 6,955,384 B1
(45) Date of Patent: Oct. 18, 2005

(54) RACK SYSTEM FOR CONSTRUCTION SCAFFOLDING

(76) Inventor: Terry D. Good, 110 Williams Rd., Portersville, PA (US) 16051

( * ) Notice: Subject to any disclaimer, the term of this patent is extended or adjusted under 35 U.S.C. 154(b) by 0 days.

(21) Appl. No.: 10/812,781

(22) Filed: Mar. 30, 2004

Related U.S. Application Data

(60) Provisional application No. 60/461,060, filed on Apr. 8, 2003.

(51) Int. Cl.[7] ..... B60P 3/00

(52) U.S. Cl. ..... 296/3; 211/49.1; 224/405

(58) Field of Search ..... 296/3; 211/49.1, 211/60.1; 224/405, 42.32

(56) References Cited

U.S. PATENT DOCUMENTS

| | | | | |
|---|---|---|---|---|
| 3,217,449 | A | | 11/1965 | Levere |
| 3,351,207 | A | | 11/1967 | Meek |
| 3,923,320 | A | | 12/1975 | Favreau et al. |
| 4,901,650 | A | | 2/1990 | Armstead |
| 4,952,114 | A | * | 8/1990 | Langer, nee Layher ..... 414/608 |
| 5,018,629 | A | | 5/1991 | Lamar |
| 5,090,761 | A | | 2/1992 | Renouard et al. |
| 2001/0045718 | A1 | | 11/2001 | Boirum |

* cited by examiner

*Primary Examiner*—Joseph D. Pape

(57) ABSTRACT

A scaffold rack system, trailer or skid mounted, consisting of support arms with retainers to hang the scaffold panels on, a trough to contain the scaffold bracing, and compartments to store and secure scaffold platforms or planks, providing a safe and easy way of handling, organizing, transporting, and storing construction scaffolding and accessories.

1 Claim, 4 Drawing Sheets

RACK SYSTEM FOR CONSTRUCTION SCAFFOLDING

CROSS-REFERENCE TO RELATED APPLICATIONS

This application claims the benefit of PPA Application No. 60/461,060 filed Apr. 8, 2003 by the present inventor.

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to a scaffold rack system, specifically to a trailer or skid mounted scaffold rack system for transporting, storing, and securing construction scaffolding and its accessories.

BACKGROUND OF THE INVENTION

Construction crews and rental companies commonly use pick-up trucks, dump trucks, and flat-bed trucks to transport construction scaffolding. When trucks are used, it's difficult to load and secure the scaffolding for transporting and generally the scaffolding must be all unloaded at once to free the truck for other uses. Often the scaffolding must be unloaded in an area not conveniently located to where it will be assembled and must be moved again later. This cost the user much time and labor.

The scaffold racks in U.S. Pat. No. 4,901,650 to Armstead 1990 Feb. 20, and U.S. Pat. No. 5,018,629 to Lamar 1991 May 28 are similar to each other. Both are a skid or pallet type and place the scaffold panels flat on the skid and stack them up upon each other, so one must bend over to handle them. With this design, these racks have little room for the accessories and no good way of securing them for transport. The bracing and platform accessories are longer than the scaffold panels, therefore when they are stacked on top they extend beyond the skid making an irregular lift. While this skid type rack may work on larger jobs that have a forklift on site to handle them, they are not practical for the smaller contractors and rental companies who do not have forklifts.

BACKGROUND OF INVENTION—OBJECTS AND ADVANTAGES

Accordingly, besides the objects and advantages of the trailer mounted scaffold rack system described in my above patent, several objects and advantages of the present invention are:

(a) to provide safe and easy handling and storing of construction scaffolding and accessories at home and on the job site, where one can load and unload all the parts while standing in an upright position.

(b) to provide safe and easy securing of the scaffolding and accessories during transportation and storage.

(c) to provide a time and labor saving method of handling scaffolding, unload as needed and leave the remainder on rack system (d) to provide a way to reduce accidents during loading and unloading (e) to provide save, fast, and easy method of handling scaffolding without the use of heavy lifting equipment Further objects and advantages are to provide a trailer mounted fabricated rack, compartment, and trough system that can be easily moved, designed in a neat, practical, and well organized package for organizing, transporting, and storing construction scaffold panels, planks, platforms, bracing, and accessories. Still further objects and advantages will become apparent from a consideration of the ensuing description and drawings.

SUMMARY

In accordance with the present invention a trailer mounted scaffold rack, compartment, and trough system for safely and easily organizing, transporting, and storing construction scaffolding and accessories.

DRAWINGS—FIGURES

FIG. 2 Shows a left side view of my trailer mounted scaffold rack, compartment and trough system, illustrated in FIG. 1, the right side view being substantially similar.

FIG. 3 Shows a rear view of my trailer mounted scaffold rack, compartment, and trough system illustrated in FIG. 1, the front view being substantially similar.

DRAWINGS—REFERENCE NUMERALS

| | | | |
|---|---|---|---|
| 10 | support arms | 12 | retainers |
| 14 | upright supports | 16 | bottom members |
| 18 | angle iron frames | 20 | front corner angles |
| 22 | rear corner angles | 26 | trough |
| 28 | front trough panel | 30 | rear trough panel |
| 32 | rear chains | 34 | rear chain snaps |
| 36 | side chains | 38 | chain binders |
| 40 | scaffold panel | 42 | scaffold platform |
| 44 | scaffold bracing | | |

DETAILED DESCRIPTION—FIG. 1 PREFERRED EMBODIMENT

Figure 1:
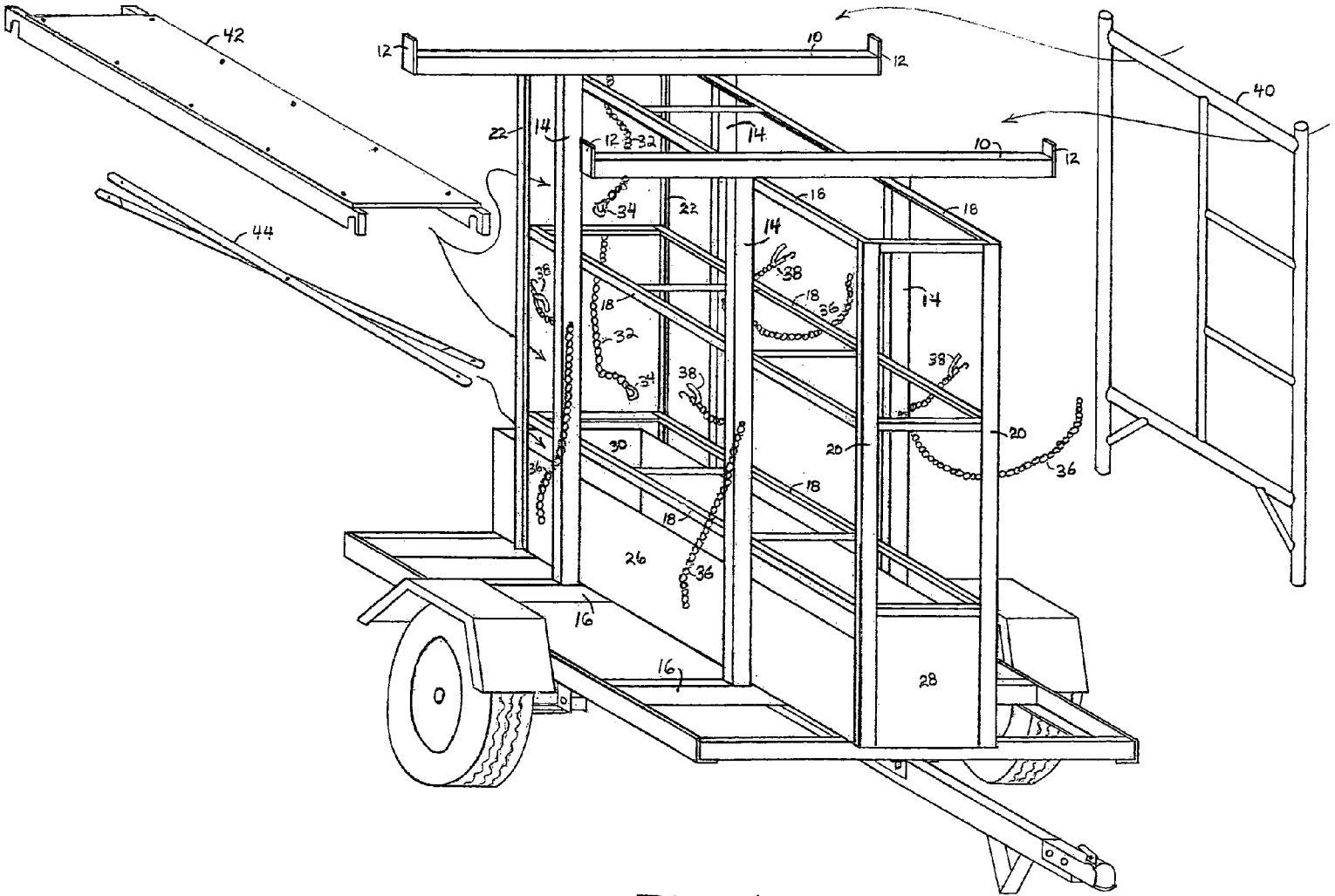
FIG. 1 Shows a perspective view of my trailer mounted scaffold rack, compartment, and trough system.
Figure 2:
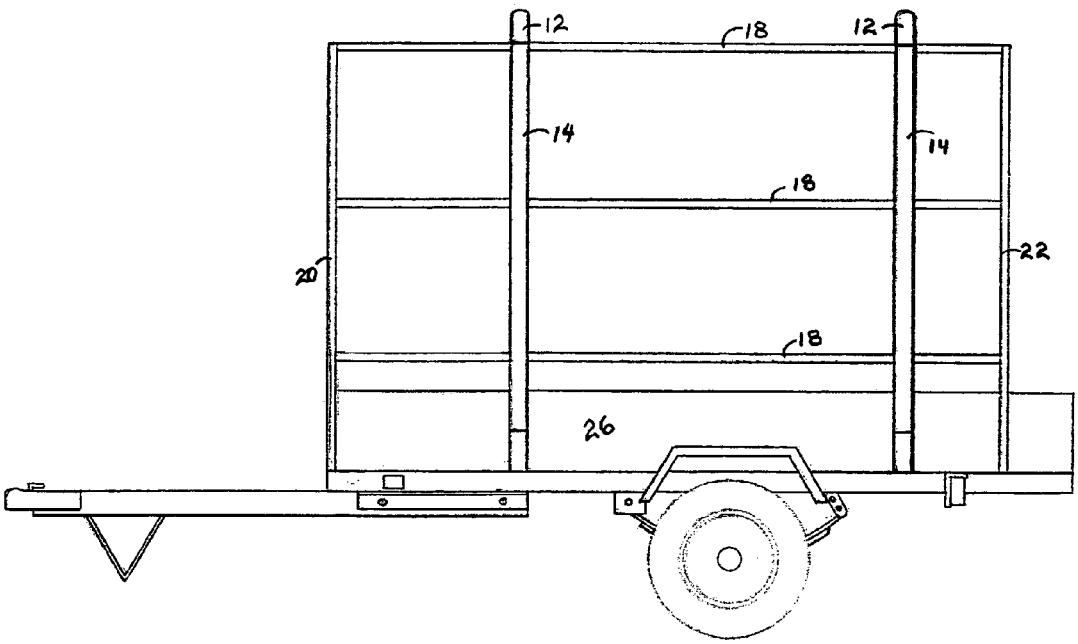
Figure 3:
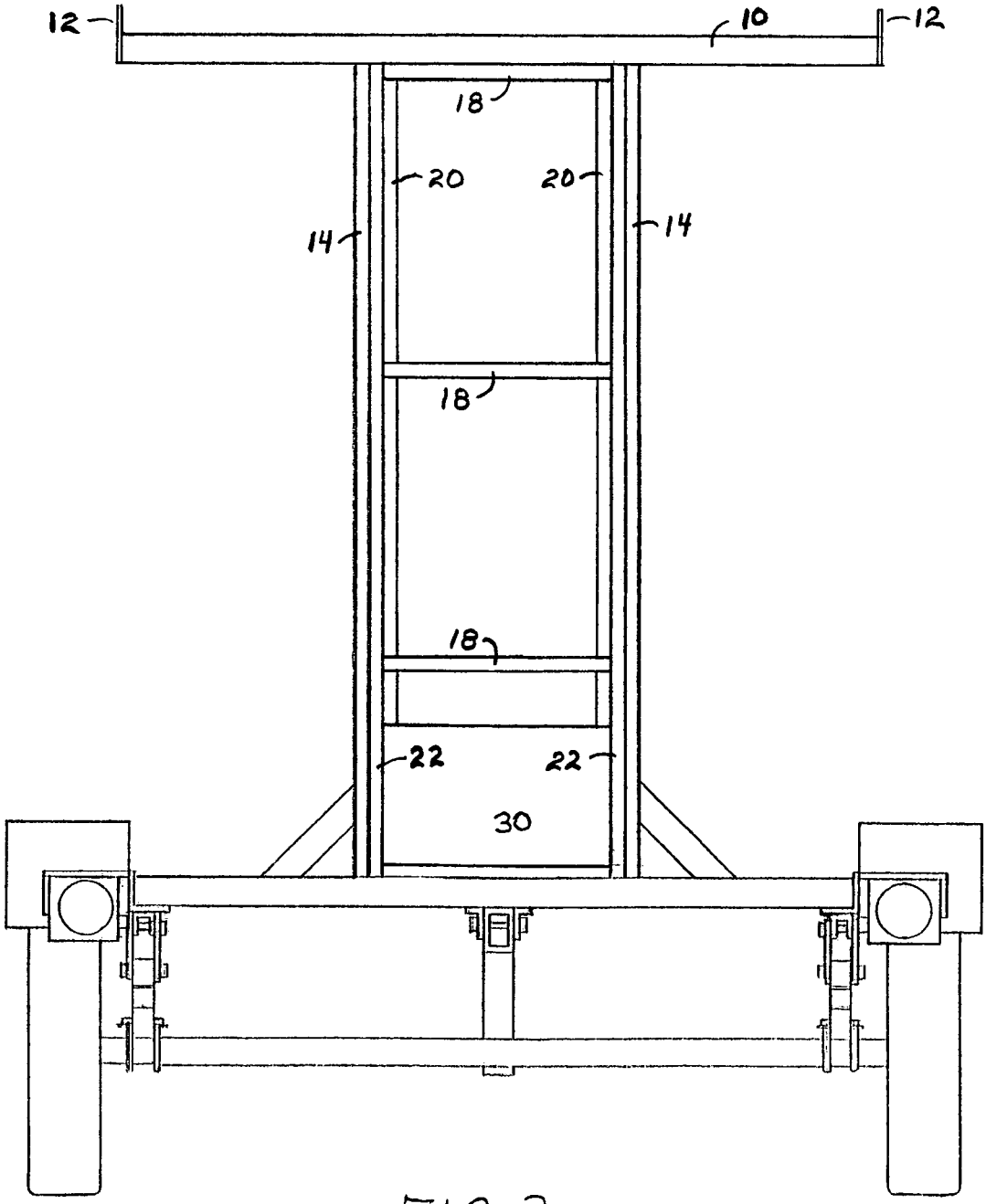
Figure 4:
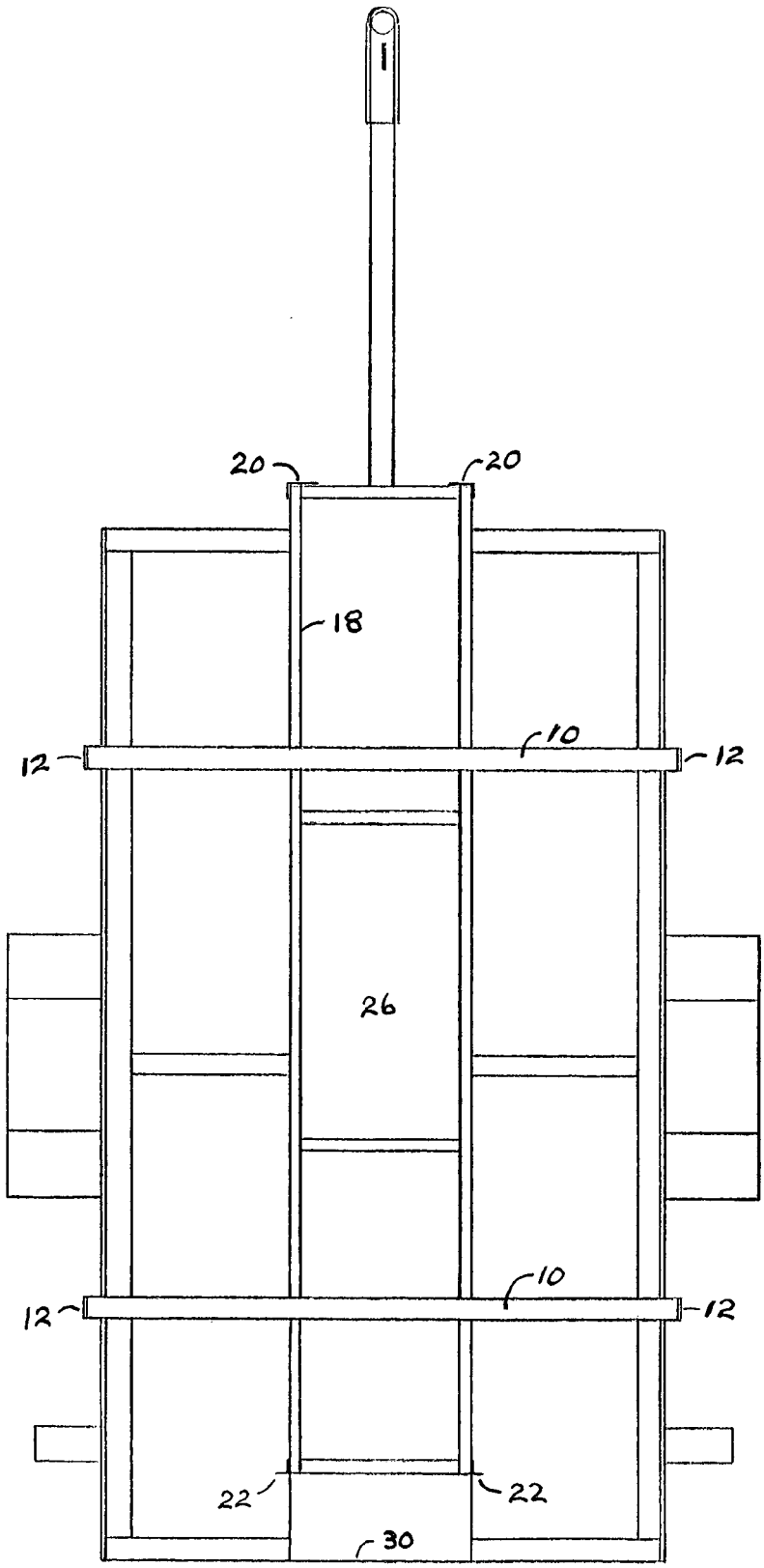
FIG. 4 Shows a top view of my trailer mounted scaffold rack, compartment, and trough system, illustrated in FIG. 1.

FIG. 1 shows a perspective view of a basic version of my trailer mounted scaffold rack, compartment and trough system. The system is made up of two support arms 10, with flat bar retainers 12 welded on each end. These arms are fastened to four upright supports 14 which are fastened to two bottom members 16.

A formed sheet metal trough 26 with a front trough panel 28 and a rear trough panel 30 is fastened between the upright supports 14 and to the bottom members 16.

Three angle iron frames 18 are spaced and fastened between the upright supports 14. Two front corner angles 20 and two rear corner angles 22 are fastened to the three angle iron frames 18 and to the trough 26 at each corner for support.

Four side chains 36 and four chain binders 38 are attached to the upright supports 14. Two rear chains 32 and two rear snaps 34 are attached to the back end of the two upper angle iron frames 18.

Operation—FIG. 1

FIG. 1 shows a perspective view of my trailer mounted scaffold rack, compartment, and trough system, showing:

(a) A scaffold panel 40 fitting over the support arms 10 and being retained by support arm retainers 12 and ultimately retained by chain 36 and binder 38.

(b) A scaffold platform 42 sliding into two compartments on angle iron frames 18 and retained by front corner angles 20 and rear chains 32 and snaps 34.

(c) Scaffold bracing 44 sliding into trough 26 and retained by front trough panel 28 and rear trough panel 30.

CONCLUSION, RAMIFICATIONS, AND SCOPE OF INVENTION

Thus the reader will see that the trailer mounted scaffold rack, compartment, and trough system provides a safe and easy method of handling, securing, transporting, and storing construction scaffolding and accessories.

While my above description contains many specificities, these should not be construed as limitations on the scope of the invention, but rather as an exemplification of one preferred embodiment thereof. Many other variations are possible. For example:

(a) Different materials, sizes, and interconnections can be used for all components.

(b) My scaffold rack, compartment, and trough system can be modified to handle other styles, sizes, and quantities of scaffold panels not shown in FIG. 1.

(c) Bins and compartments can be modified or added to carry and store different brackets and accessories not shown in FIG. 1.

(d) Locking lids, covers, doors, and anti-theft devices can be installed.

(e) Multiple rack systems can be used on one trailer or skid to increase quantities.

(f) Compartments can be lengthened to carry long scaffold planks.

(g) My scaffold rack, compartment, and trough system can be mounted on trucks, trailers, or skid mounted to be lifted with a crane, forklift, or roll-off system.

Accordingly, the scope of the invention should be determined not by the embodiments illustrated but by the appended claims and their legal equivalents.

I claim:

1. A rack system mountable to a horizontal portion of a transport device for storing and transporting construction scaffolding including scaffold panels, scaffold platforms, and scaffold bracing, said rack system comprising:

a plurality of upright supports extending upwardly from the horizontal portion of the transport device and being arranged in laterally spaced pairs;

a support arm being connected to each pair of said plurality of upright supports at upper end thereof, wherein both ends of each said support arm extends laterally outward from each pair of said plurality of upright supports on opposite sides thereof so as to be configured to receive the scaffold panels on either side of the rack system;

a retainer being provided at each end of each support arm and extending upwardly from a top surface of each support arm so as to be configured to prevent the scaffold panels from sliding off of the support arms;

means provided on each of said plurality of upright supports for securing the scaffold panels thereto;

a plurality of rectangular angle iron frames horizontally disposed and longitudinally extending between said pairs of said plurality of upright supports to form at least two compartments configured to receive the scaffold platforms; the plurality of rectangular angle irons extending forwardly beyond a forward most pair of said plurality of upright supports and extending rearwardly beyond a rearward most pair of said plurality of upright supports, wherein a vertically disposed pair of front corner angles and a vertically disposed pair of rear corner angles are connected to the front ends and the rear ends, respectively, of the plurality of rectangular angle iron frames, the front corner angles being configured to retain the forwardly disposed ends of the scaffold platforms and means for retaining the rearwardly disposed ends of the scaffold platforms being provided on the rear ends of several of the plurality of rectangular angle iron frames; and a trough including side panels secured to the plurality of upright supports and front and side panels secured to the front and rear pairs of corner angles, respectively, which is configured to receive scaffold bracing therein.

* * * * *